US005341716A

United States Patent [19]

Donohoe

[11] Patent Number: 5,341,716

[45] Date of Patent: Aug. 30, 1994

[54] PLASTIC-CLAD WOODEN DRUMSTICK AND METHOD OF MAKING

[75] Inventor: David G. Donohoe, Springville, Calif.

[73] Assignee: Aquarian Accessories Corporation, Anaheim, Calif.

[21] Appl. No.: 110,765

[22] Filed: Aug. 23, 1993

Related U.S. Application Data

[63] Continuation of Ser. No. 844,106, Mar. 2, 1992, abandoned.

[51] Int. Cl.[5] ..... G10D 13/02

[52] U.S. Cl. ..... 84/422.4

[58] Field of Search ..... 84/422.4, 422.3, 422.2, 84/422.1

[56] References Cited

U.S. PATENT DOCUMENTS

| | | | |
|---|---|---|---|
| 3,608,419 | 9/1971 | Russell | 84/422.4 |
| 3,722,350 | 3/1973 | Cordes | 84/422.4 |
| 3,859,887 | 1/1975 | Buchanan | 84/422.4 |
| 4,246,826 | 1/1981 | Warrick et al. | 84/422.4 |
| 4,320,688 | 3/1982 | Donohoe | 84/422.4 |
| 5,179,237 | 1/1993 | Grossman | 84/422.4 |

*Primary Examiner*—Michael L. Gellner
*Assistant Examiner*—Cassandra C. Spyron
*Attorney, Agent, or Firm*—William L. Chapin

[57] ABSTRACT

A drumstick of improved durability for use with musical instruments such as drums and cymbals includes an elongated wooden core having an elongated, generally cylindrically shaped shaft section, a shorter frusto-conically shaped front section which tapers to a smaller diameter neck, and a short tip section joined to the neck. Formed in the outer cylindrical wall of a central longitudinal portion of the shaft is an elongated, shallow annular groove. A polymer sleeve having greater resistance to rimshot damage than wood is positioned coaxially over the shaft, within the groove. In the preferred method of fabrication, the wooden core is placed in a cavity of an injection mold, and molten fiberglass-filled nylon injected into a first enclosed region surrounding the grooved portion of the shaft, to form the sleeve. Optionally, the cavity may have a second enlarged region surrounding the tip section of the core, the second enlarged region communicating with the first enlarged region. When molten plastic is injected into the mold, the second enlarged region is also filled with liquid plastic, forming a durable striking bead over the tip section of the core. Preferably, the front portion of the tip section has a larger diameter than the neck portion, thereby securely captivating the striking bead when the plastic solidifies.

21 Claims, 2 Drawing Sheets

PLASTIC-CLAD WOODEN DRUMSTICK AND METHOD OF MAKING

This application is a continuation of application Ser. No. 07/844,106, filed Mar. 2, 1992 abandoned.

BACKGROUND OF THE INVENTION

A. Field of the Invention

The present invention relates to percussion instruments used in bands and orchestras. More particularly, the invention relates to an improved drumstick useable with snare drums, cymbals, and related percussion instruments.

B. Description of Background Art

Drums of various types continue to be an indispensable requirement for most bands and orchestras. Many musical groups employ a full complement of percussion instruments including bass drums, tom-toms, snare drums and cymbals. Hand-held drumsticks are used to strike the drumheads of snare drums, tom-toms and the like, and the surfaces of cymbals, to produce desired percussion sounds. Traditionally, drumsticks are made of a relatively hard wood such as hickory.

Although many attempts have been made to replace the wood used in traditional drumsticks with various synthetic materials, including composites, wooden drumsticks are still preferred by most musicians, for a variety of reasons.

For example, most composite drumsticks have insufficient rigidity to satisfy typical drummers. Those composite drumsticks that do have a rigidity approaching that of wood are usually quite expensive, selling for several times the price of wooden drumsticks. The higher cost of composite drumsticks results from the high cost of composite materials such as graphite, which is a highly preferred and often used composite material.

In addition to the higher cost of composite drumsticks relative to those made of wood, drumsticks made of synthetic materials present certain other disadvantages. Thus, even drumsticks made from graphite composites have less rigidity than wooden drumsticks. This lack of rigidity causes the drumstick to vibrate excessively when struck against a drumhead, rim or cymbal. A great majority of drummers find the excessive vibration of composite drumsticks to be disconcerting, or even unacceptable.

Since most composite drumsticks are made from either a graphite or fiberglass reinforced plastic resin, they are usually heavier than wooden drumsticks. Depending upon the characteristics of the particular composite materials, some composite drumsticks may be substantially heavier than wooden drumsticks. This increased weight is highly undesirable, since it can more quickly tire a drummer engaged in vigorous drum and cymbal playing.

The higher cost, lack of rigidity, increased vibration susceptibility and greater weight of composite drumsticks described above are all negative characteristics from a drummer's point of view. Thus, increased durability alone is usually not a sufficient reason to justify the higher cost of composite drumsticks, considering the other negative properties of composite drumsticks. For these reasons, not to mention tradition, the vast majority of drummers still prefer wooden drumsticks.

Although wooden drumsticks are preferred by most drummers, for the reasons stated above, drumsticks made of wood do have a serious drawback, namely limited durability. The two localities of a wooden drumstick that are most vulnerable to damage are the central longitudinal portion of the shaft or handle, and the tip.

The central longitudinal portion of a drumstick shaft is particularly susceptible to damage, which can result in early failure of the drumstick, when used to perform "rimshots."

To perform a rimshot, the head and metal rim of a drum are struck simultaneously. This simultaneous striking of the head and drum rim produces a real "crack," not unlike the sound of a rifle shot. It is the loudest stroke that can be performed on a drum. Rimshots are employed more frequently than in the past, to achieve a maximum volume, according to the dictates of modern musical compositions.

Rimshots are so called because the drumstick shaft makes direct contact with the metal rim that holds the drumhead in place. Most drum rims are made from rolled steel or heavy duty die-cast metals. To say that such rims are unforgiving to wooden drumsticks struck on the rims would be a gross understatement.

When a wooden drumstick impacts a drumhead rim during a series of rimshots, the impacted central longitudinal portion of the drumstick shaft oftentimes begins to break down and splinter almost immediately. In fact, it is not unusual for a drummer to wear out several pairs of drumsticks in one evening, depending upon the strength of the drummer and the type and design of the drum rims.

Once the center portion of a drumstick shaft becomes splintered, frayed and soft, the sharp attack sound of the rimshot is lost. When so damaged, the drumstick becomes useless for any playing requiring rimshots, even though the rest of the stick may still be in a playable condition. Some drummers use larger-than-normal, heavier, more durable wooden drumsticks to achieve greater useful life. However, most of them would prefer to use drumsticks of normal size and weight.

The tip of wooden drumsticks are also subject to premature wear and failure. This is especially true when the drumsticks are used to strike cymbals, which are made of a bronze alloy. In several hours of playing on cymbals, the wooden tip of a drumstick begins to soften once the varnish or other finish coat is worn off. The tip then begins to fray rapidly. The deteriorated state of the tip makes it impossible to achieve a clean, clear attack on the cymbals, rendering the stick useless for that purpose. Wooden drumstick tips are also prone to chipping at any time.

To solve the problem of premature tip failure, a number of manufacturers press-fit a nylon tip to the drumstick, securing the tip to the stick with an adhesive. This construction does not solve the rimshot wear problem, but does extend tip life. However, this construction presents new problems, as will now be described.

Nylon tips often loosen during hard playing. This is because the adhesive joint joining the tip to the stick can be quickly de-adhered in response to shock and vibration experienced during vigorous playing. As the glue breaks down, the tip can now fly off during a performance, producing a potentially hazardous projectile. A number of well-known drummers have sustained moderate to serious eye injuries as a result of this problem.

Also, hairline cracks can occur in a tip that is press-fitted to a drumstick, owing to stresses created in the tip during the attachment operation. Often not visible, these hairline cracks can result in a nylon tip flying across the stage during a performance.

A number of prior art references disclose improvements in drumsticks. Those references which the present inventor is aware of consist of the following nine United State patents and one German patent.

Zipperstein, U.S. Pat. No. 1,739,275, Dec. 10, 1929, Drumstick:

Discloses a metallic sleeve arranged to fit over reduced diameter portions formed on adjacent sections of a drumstick, to hold the sections together.

Criscuolo, U.S. Pat. No. 3,175,450, Mar. 30, 1965, Drumstick:

Discloses a wooden drumstick which is completely covered by a layer of hardened plastic material, which layer may contain wooden chips as a filler.

Kline, U.S. Pat. No. 4,040,323, Aug. 9, 1977, Synthetic Material Drumstick:

Discloses a drumstick which is machined from fiberglass reinforced polyester resin rod stock.

Fiedler, et al., U.S. Pat. No. 4,047,460, Sep. 13, 1977, Drumstick:

Discloses a drumstick fabricated from two generally semi-cylindrically shaped hollow shells made of randomly oriented carbon or graphite fibers in a nylon matrix. The two shells are ultrasonically welded together to form an integral drumstick.

Petillo, U.S. Pat. No. 4,114,503, Sep. 13, 1977, Drumstick:

Discloses a composite drumstick formed from an elongated cruciform cross-section core made of a material such as aluminum, onto which are bonded strips of wood. The composite assembly is turned on a lathe until the desired final external form of the drumstick is achieved.

Warrick, et al., U.S. Pat. No. 4,246,826, Jan. 27, 1981, Drumstick:

Discloses a drumstick having a wooden body with a cylindrical opening in the front end thereof for receiving a flexible fiberglass rod end overlain by a frusto-conically shaped reinforcing sleeve.

Donohoe, U.S. Pat. No. 4,320,688, Mar. 23, 1982, Synthetic Drumstick and Method of Making:

Discloses a drumstick having a hollow tubular central core sealed at the rear end thereof with a butt plug, and a flexible stud inserted into the front opening of the core. A glass-filled nylon skin is molded over the core and stud, forming a striking tip where the skin overlies the forward end of the stud. Heiskill, U.S. Pat. No. 4,462,296, Jul. 31, 1984, Drumstick For Playing Percussion Instruments:

Discloses a wooden drumstick having scratches and ridges formed in the handle portion for providing a non-slip grip. A polyurethane coating is applied to the tapered front portion and head to strengthen the drumstick. Donohoe, U.S. Pat. No. 4,763,557, Aug. 16, 1988, One-Piece Hollow Drumstick And Method of Making:

Discloses a one-piece hollow drumstick which is injection molded from a plastic material. German Patent DE, 4,001,403, Vogel, Jul. 7, 1990:

Discloses a drumstick having an elongated sleeve made of woven polyurethane fibers and tightly wrapped over that portion of the drumstick extending rearward some distance from the junction of the front tapered portion of the stock with the handle portion.

The present inventor is unaware of any entirely satisfactory prior art solutions to the problem of increasing the life of wooden drumsticks.

OBJECTS OF THE INVENTION

An object of the present invention is to provide an improvement in the construction of wooden drumsticks, which increases their durability and useful life.

Another object of the invention is to provide an improved construction for wooden drumsticks which increases the resistance of the shaft of the drumstick to rimshot damage.

Another object of the invention is to provide a wooden drumstick with improved resistance to rimshot damage, without significantly altering the weight or feel of the drumstick.

Another object of the invention is to provide an improved wooden drumstick with increased resistance to rimshot damage, without significantly altering the acoustics of the drumstick.

Another object of the invention is to provide a wooden drumstick having improved resistance to damage of the tip.

Another object of the invention is to provide a method for fabricating a wooden drumstick having improved resistance to rimshot damage of the drumstick shaft.

Another object of the invention is to provide a method for fabricating a wooden drumstick having improved tip durability.

Various other objects and advantages of the present invention, and its most novel features, will become apparent to those skilled in the art by persuing the accompanying specification, drawings and claims.

It is to be understood that although the invention disclosed herein is fully capable of achieving the objects and providing the advantages described, the characteristics of the invention described in this specification are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved wooden drumstick, and a novel method for manufacturing the improved drumstick.

The improved drumstick according to the present invention includes an elongated, generally circular cross-section blank or pre-form fabricated from a hard wood such as hickory, by turning on a lathe or by a similar fabrication method. The blank has a shape generally similar to that of conventional wooden drumsticks. Thus, the drumstick blank according to the present invention has an elongated cylindrical body, a shorter frusto-conically shaped front section which tapers to a front neck portion, and a tip end section of larger diameter than the neck and joined thereto.

The preferred embodiment of the drumstick blank according to the present invention differs from prior art drumsticks in having in the central longitudinal portion thereof an elongated shallow annular groove, extending approximately equal distances forward and rearward of the transverse center plane of the stick. The central portion of the drumstick is clad with a protective sleeve which is made of material which is sufficiently hard and rigid to provide a wood-like sound when struck against the rim of a drum to perform a rimshot, yet which is substantially more resistant to impact damage than the wood from which the drumstick is made.

In the preferred method of manufacturing the improved drumstick according to the present invention, the grooved blank is placed in cylindrical channel or cavity formed jointly between mating halves of an injection molding die. Molten plastic is then injected into the cavity, forming a thin, elongated cylindrical sleeve over the grooved area of the drumstick blank. Preferably, a high strength composite plastic such as nylon filled with tensile-strength increasing fibers of carbon, boron or fiberglass is used as a molding material. When the composite material cools, the molded sleeve shrinks slightly, bonding the sleeve tightly to the drumstick blank.

At the time a protective sleeve is injection molded around the shank of the blank drumstick, a protective coating may be clad to the tip end section of the drumstick to form a striking bead, using the same molten plastic in an oval mold cavity surrounding the tip of the blank and connected via an internal mold runner to the sleeve cavity.

DETAILED DESCRIPTION OF THE INVENTION

Figure 1:
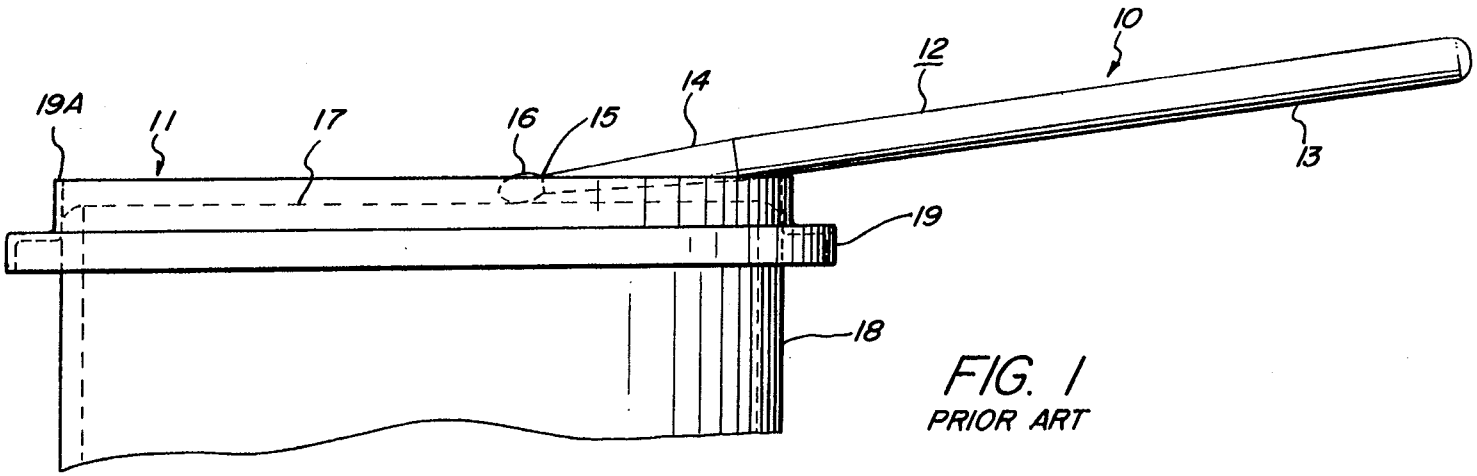
FIG. 1 PRIOR ART
FIG. 1 is a side elevation view of a prior art drumstick being used to execute a rimshot on a drum.

FIG. 1 shows a typical prior art drumstick 10 being used to execute a rimshot on a drum 11. As shown in FIG. 1, drumstick 10 has an elongated cylindrical shaft 12. A rear end portion 13 of shaft 12 serves as a handle, and is normally grasped in a drummer's hand. Drumstick 10 also has a frusto-conically shaped front portion 14 which tapers in a forward direction to a neck 15 of smaller diameter than shaft 12. Joined to neck 15 is a tip or striking bead 16 having a circular transverse cross-sectional shape and an oval longitudinal cross-sectional shape.

As shown in FIG. 1, drum 11 has a flexible circular drumhead 17 secured to a rigid cylindrical shell 18 by means of a stepped-diameter, circular cross-section tensioning rim 19. Rim 19 is usually made of rolled steel or heavy die-cast metal.

To perform a rimshot with drumstick 10 and drum 11, tip 16 of the drumstick is struck against drumhead 17, while the central portion of drumstick shaft 12 is simultaneously stuck against the upper annular lip 19A of rim 19. To achieve the sound quality and volume level usually sought after when performing a rimshot, rim 19 is usually impacted with substantial force. This force is oftentimes sufficient to begin splintering and ultimate degradation of drumstick 10 from the very first rimshot executed with the stick.

FIGS. 2 through 5, and FIG. 7, illustrate one embodiment of an improved wooden drumstick according to the present invention, which has substantially greater resistance to rimshot damage than prior art drumsticks.

Figure 2:
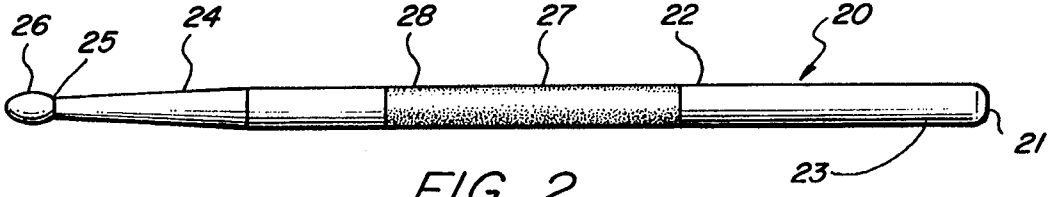
FIG. 2 is an upper plan view of a plastic-clad drumstick according to the present invention.
Figure 3:
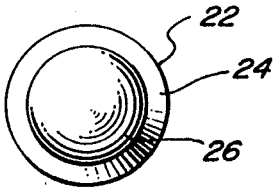
FIG. 3 is a front elevation view of the drumstick of FIG. 2.
Figure 4:
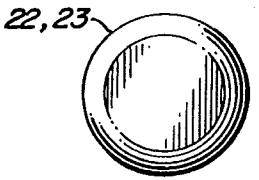
FIG. 4 is a rear elevation view of the drumstick of FIG. 2.

As shown in FIGS. 2–4, the improved drumstick 20 according to the present invention has an exterior shape and size substantially similar to the typical prior art wooden drumstick 10 shown in FIG. 1. Thus, drumstick 20 has an elongated cylindrical shaft 22 having a rear handle portion 23, a frusto-conically shaped front section 24 which tapers forward to a smaller diameter neck 25, and a tip or striking bead 26 having a circular transverse cross-sectional shape and an oval longitudinal cross-sectional shape. That portion of drumstick 20 so far described is preferably made from a hard wood such as hickory, by lathe turning.

Improved drumstick 20 is distinguished from prior art wooden drumsticks such as drumstick 10 shown in FIG. 1, by the addition of an elongated tubular sleeve 27 fitted coaxially over a central longitudinal portion of shaft 22 of the drumstick. Sleeve 27 should be made of a material which has substantially greater resistance to impact damage than wood, but which also has a surface hardness similar to that of wood. The purpose for the latter characteristic is, of course, to ensure than improved drumstick 20 will achieve the sharp, clean attack sound of a conventional all-wood drumstick, when used to execute a rimshot, as shown in FIG. 1. I have found that fiberglass filled polymers provide both the desired resistance to impact damage, and the surface hardness required to produce the desired sharp attack sound. In particular, I have found that nylon filled with 40 percent fiberglass is a highly desirable material for sleeve 27.

Preferably, sleeve 27 is positioned symmetrically with respect to the transverse mid-plane of drumstick 20. With this arrangement, drumstick 20 can readily be reversed to perform rimshots in which the butt end 21 of the drumstick impacts the head 17 of a drum, with lip 19A of rim 19 still impacting protective sleeve 27. For a drumstick having a length of about 16 inches, I have found that a suitable length for sleeve 27 is 4½ inches or more.

In the preferred embodiment of improved drumstick 20, the outer cylindrical surface 28 of sleeve 27 is made flush with the uncovered portion of shaft 22, by a novel fabrication method which will now be described.

Figure 5:
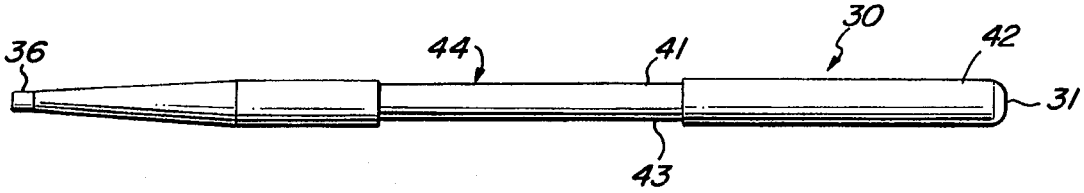
FIG. 5 is a fragmentary upper plan view of the drumstick of FIG. 2, showing the drumstick at a pre-formed, partially completed phase of manufacture.

As shown in FIG. 5, the preferred embodiment of drumstick 20 is fabricated from a wooden pre-form 30. Pre-form 30 is substantially identical in size and shape to finished drumstick 20, save for an elongated, shallow annular groove 41 cut in the cylindrical wall surface 42 of the blank pre-form. Optionally, front end 36 of blank 30 may be cut to a smaller size than finished tip 26 of drumstick 20, to allow forming a protective covering over front end 36, as will be described below.

Figure 6:
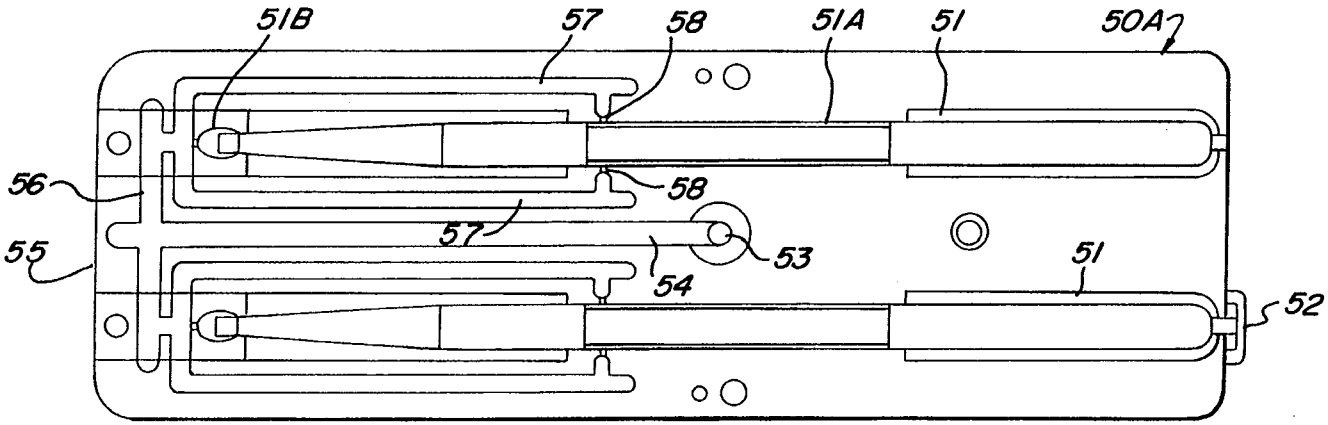
FIG. 6 is an upper plan view of a mold used in the manufacture of the drumstick of FIG. 2.

The novel method of forming a protective sleeve around drumstick pre-form 30 utilizes injection molding. FIG. 6 is an upper plan view of one-half of an injection mold 50 suitable for forming protective sleeve 27 simultaneously on two drumstick pre-forms 30.

Injection mold-half 50A has two longitudinally elongated cavities 51. Each cavity 51 has a longitudinal cross-sectional shape substantially identical to that of a finished drumstick 21. Thus, when a drumstick blank or pre-form 30 is placed in a cavity 51, the lower half of the pre-form is held with a negative clearance of about 0.004 inch to 0.010 inch between the blank and the semicircular wall of the cavity, except in the areas of groove 41 and front end 36 of the preform. The latter two areas 51A and 51B, respectively of cavity 51, have the same cross-sectional size and shape as a finished drumstick 20. Therefore, there is clearance space between the inner walls of oval cavity section 51B and pre-form end 36, and between the inner walls of semi-cylindrical cavity section 51A and undercut cylindrical wall surface 43 of the longitudinally grooved central section 44 of pre-form 30. The aforementioned clearance spaces are of the proper size and shape to receive molten plastic which hardens to form a plastic clad tip 26 and sleeve 27 of a finished drumstick 20 (FIG. 2) as is explained in further detail below.

As will be understood by those skilled in the art of injection molding, an upper mold half (not shown) having cavities mirror-symmetric, through the upper surface of lower mold half 50A, with lower mold cavities 51 would be matched with the lower half and clamped thereto, to make a complete mold. Prior to clamping upper and lower mold halves together, a wooden drumstick pre-form 30 would be placed in each of the cavities 51 in lower mold half 50A. Each pre-form 30 is secured in a fixed position within a mold cavity 51, as by means of screws 52 threaded into the butt end 31 of wooden drumstick pre-form 30. Because of the aforementioned negative clearance between the mold cavities and the un-relieved surfaces of wooden preform 30, these surfaces are compressed when the mold halves are clamped together.

As shown in FIG. 6, lower mold half 50A includes a bore 53 extending upward through the thickness dimension of the mold half, from its lower surface through the upper surface. The purpose of bore 53 is to provide a conduit for molten plastic issuing from a nozzle exterior to mold 50 into the interior of the mold. Thus used, bore 53 is referred to as a sprue. A longitudinally disposed, semi-cylindrically shaped main channel or runner 54 extends from sprue 53 towards the transverse end wall 55 of mold half 50A. A mirror-symmetric semi-cylindrical channel corresponding to runner 54 and the remaining channels discussed below are formed in the lower surface of the upper mold half, so that cylindrical channels or runners are formed when the upper and lower mold halves are clamped together.

Main longitudinal runner 54 communicates with a transversely disposed runner 56. Each end of transverse runner 56 connects to a pair of longitudinally disposed branch runners 57, which run along opposite sides of mold cavity 51. Near the inner end of each branch runner 57, a smaller diameter channel or gate 58 communicates with mold cavity 51, near the front end of region 51A of the cavity where sleeve 57 is to be formed.

To clad drumstick pre-form 31 with a rimshot damage-resistant sleeve 27, lower mold half 50A is clamped to a mating upper mold half. The complete mold assembly is then placed in an injection molding machine, preferably with transverse face 55 of mold half 50A in a horizontal position, below sprue 53. Molten plastic is then forced into sprue 53, travelling through runners 54, 56, 57 and through gates 51 into cavity section 51A. Here, molten plastic travels upwards along undercut wall surface 43 of wooden pre-form 30, along the entire length of groove 41, filling the space between the undercut wall surface and the inner cylindrical surface of the cavity. Since mold 50 is kept at a temperature lower than the solidification temperature of the plastic, the plastic rapidly solidifies to form a sleeve 27 around grooved portion 40 of drumstick pre-form 30. Because the plastic shrinks upon cooling, sleeve 27 is bonded very tightly to pre-form 31, to form a finished drumstick 20 as shown in FIG. 2.

I have found that nylon filled "i.e., raid free" with about 40 percent ± ten percent fiberglass strands having an average diameter of about 0.003 inch, an average length of $\frac{3}{8}$ inch to $\frac{1}{2}$ inch and an average tensile strength of about 60,000 psi has the desired molding properties and finished hardness and durability for sleeve 27. The strands tend to become oriented parallel to the longitudinal axis of the sleeve 27 in traveling through runners 54, 56, 67 and through gates 51 into cavity section 51A. I have also found that the minimum wall thickness for injection molded sleeve 27 is about 0.040 inch. When attempts were made to mold sleeve 27 with a wall thickness of less than 0.040 inch, molten plastic tended to solidify in cavity 51A before reaching the end of the cavity, resulting in formation of a fragmentary sleeve.

Figure 7:
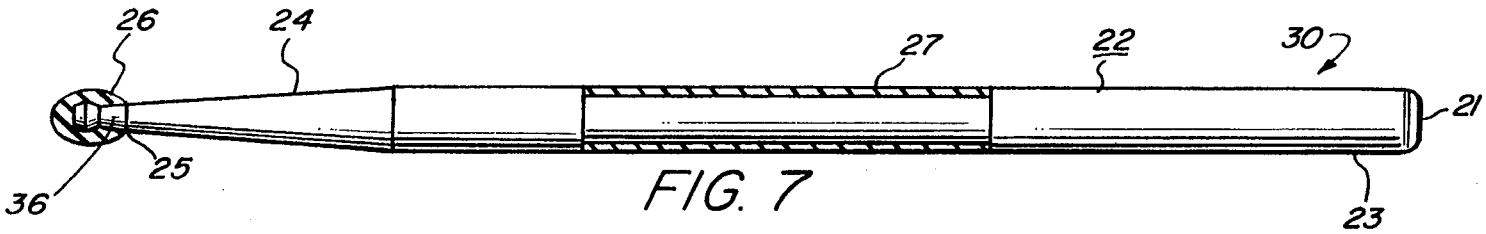
FIG. 7 is a longitudinal sectional view of the drumstick of FIG. 2, on a somewhat enlarged scale.

As shown in FIG. 6, mold 50A may also contain oval tip cavities 51B, for cladding end 36 of pre-form 30 with the same glass-filled nylon used to mold sleeves 27. Since nylon tip 26 is injection molded over end 36 of pre-form 30, rather than being press-fitted onto the wooden drumstick, the end of the pre-form may be reverse tapered, having a front portion of larger diameter than the rear portion, as shown in FIG. 7. Thus, when molded tip 26 solidifies over end 36 of pre-form 31, it is virtually impossible for the tip to fly off, even with the hardest playing of drumstick 20.

From the foregoing description, it is clear that the formation of an injected mold plastic sleeve in a groove provided in the shaft of a wooden drumstick is a novel and highly effective method of fabricating a drumstick having superior resistance to impact damage. In an alternate embodiment of the novel drumstick having a plastic-clad longitudinal shaft section a separately fabricated tubular sleeve may be attached to the shaft of the drumstick. For example, a tubular sleeve could be fabricated with an inner diameter sufficiently small to tightly grip the shaft of a wooden drumstick. Heating the sleeve will expand the inner diameter sufficiently to permit sliding the sleeve over the shaft. Allowing the sleeve to cool will cause it to shrink into a tight fit on the shaft. In another alternate embodiment of the novel drumstick according to the present invention, grooved section 41 of a wooden drumstick preform 30 may be wrapped with a durable polymer material having properties identical to or similar to the fiberglass filled nylon used in the injection-molded version of the invention.

What is claimed is:

1. A drumstick for use with musical percussion instruments, said drumstick having improved durability and comprising;

a. an elongated rigid body, said body having an elongated generally cylindrically-shaped shaft section having an outer cylindrical surface, a shorter frusto-conically-shaped front section which tapers to a smaller diameter neck, and a still shorter tip section of larger diameter than said neck, and b. an elongated tubular sleeve fitted coaxially over a longitudinal portion of said shaft section and attached thereto, said sleeve being fabricated from an impact-resistant material and having an outer cylindrical wall surface continuous with said outer cylindrical surface of said shaft section.

2. The drumstick of claim 1 wherein said body is one-piece.

3. The drumstick of claim 1 wherein said body is further defined as being made of wood.

4. The drumstick of claim 1 wherein said impact resistant material is further defined as being substantially void-free.

5. The drumstick of claim 4 wherein said void-free material is further defined as having a surface hardness approximating that of wood.

6. The drumstick of claim 5 wherein said void-free material is further defined as being a polymer.

7. The drumstick of claim 6 wherein said void-free polymeric material is further defined as being a composite.

8. The drumstick of claim 7 wherein said composite material is further defined as containing fiberglass strands.

9. The drumstick of claim 7 wherein said composite material is further defined as containing carbon fibers.

10. The drumstick of claim 7 wherein said composite material is further defined as containing boron fibers.

11. The drumstick of claim 1 wherein said sleeve is further defined as being a one-piece solid cylinder having a central coaxial bore; wherein, said outer surface is continuous.

12. The drumstick of claim 1 wherein said sleeve is further defined as having a central coaxial bore; wherein said outer surface is continuous.

13. The drumstick of claim 12 wherein said sleeve is further defined as being made of a polymeric material.

14. The drumstick of claim 13 wherein said polymeric material is further defined as containing tensile-strength increasing fibers.

15. The drumstick of claim 14 wherein said polymeric material is further defined as being nylon.

16. The drumstick of claim 15 wherein said tensile-strength increasing fibers are further defined as being fiberglass.

17. A drumstick having improved resistance to damage by rim shots, said drumstick comprising;

a. an elongated rigid body, said body having an elongated generally cylindrically-shaped shaft section, said shaft section having formed in the outer cylindrical wall surface of a longitudinal portion thereof a longitudinally elongated, shallow annular groove, an elongated frusto-conically-shaped front section which tapers to a smaller diameter neck, and a short tip section, and b. a tubular sleeve fitted coaxially over said shaft section, said sleeve being positioned longitudinally within said groove and being secured within said groove, said sleeve having an outer cylindrical wall surface continuous with said outer cylindrical wall surface of said shaft section.

18. The drumstick of claim 17 wherein said body is one-piece.

19. The drumstick of claim 17 wherein said body is further defined as being made of wood.

20. The drumstick of claim 17 further including a protective oval cross-sectional shape striking head covering said tip section of said body, said tip section having an outer transverse end and a reduced diameter portion located longitudinally inwards thereof, said head having an inner cavity, said inner cavity having an inner wall surface which conformally contacts said tip section.

21. The drumstick of claim 17 wherein said sleeve is further defined as being a solid cylinder.

* * * * *